US005181963A

United States Patent [19]

Degrauwe et al.

[11] Patent Number: 5,181,963

[45] Date of Patent: Jan. 26, 1993

[54] CURTAIN COATER FOR PHOTOGRAPHIC ELEMENTS

[75] Inventors: Dirk M. Degrauwe, St. Niklaas; Marcel A. Raemdonck, Hove; Eduard A. Geleyns, Wilsele, all of Belgium

[73] Assignee: Agfa-Gevaert N. V., Mortsel, Belgium

[21] Appl. No.: 644,230

[22] Filed: Jan. 22, 1991

[30] Foreign Application Priority Data

Jan. 29, 1990 [EP] European Pat. Off. ..... 90200191

[51] Int. Cl.[5] ..... B05C 5/00

[52] U.S. Cl. ..... 118/325; 118/DIG. 4

[58] Field of Search ..... 118/324, 325, DIG. 4; 427/420

[56] References Cited

U.S. PATENT DOCUMENTS 3,369,522 2/1968 Alix .

3,867,901 2/1975 Greiller ..... 118/325

FOREIGN PATENT DOCUMENTS 1269546 5/1968 Fed. Rep. of Germany .

*Primary Examiner*—W. Gary Jones

*Assistant Examiner*—Charles K. Friedman

*Attorney, Agent, or Firm*—William J. Daniel

[57] ABSTRACT

Curtain coater for coating a layer of liquid photograph coating composition on a continuous web, which comprises a coating hopper (10), a roller (18) for supporting the web while moving past the coating hopper to receive a layer (16) of coating composition produced by the hopper and, arranged closely to and slightly upstream of the coating locus of the curtain on the web, an elongated brush arrangement (24) extending across the web, the bristles of which are flexible and in resilient contact with the web surface. The brush arrangement functions to reduce the effect of air carried along by the moving web on the liquid curtain in conjunction with an upstream air shield in the form of an arcuately curved plate coaxial with the supporting roller and spaced closely from the web surface.

7 Claims, 8 Drawing Sheets

CURTAIN COATER FOR PHOTOGRAPHIC ELEMENTS

BACKGROUND OF THE INVENTION a. Field of the Invention

The present invention relates to a curtain coater for coating a layer of liquid photographic coating composition on a continuous web in the manufacture of a photographic element.

Photographic coating compositions typically consist of aqueous solutions or dispersions of hydrophilic colloids with or without other materials dissolved or dispersed therein. They are liquid compositions of relatively low viscosity, for example, a viscosity of less than about 150 centipoises, and most frequently in the range from about 5 to about 100 centipoises, and after being coated onto the surface of the support are subjected to controlled temperatures to effect setting and drying. Coating compositions are in use in the photographic art which very much differ in chemical composition and also, to a more limited extent, in physical characteristics, and a number of different materials are in common use as the support. Thus, for example, the support may be made of paper, film base, glass, cloth and the like, and it may be coated in the form of discrete sheets or, as is more usually the case, in the form of a continuous web.

The manufacture of photographic elements is an extremely difficult art requiring extremely accurate control. Unlike coating operations in other arts, where complete coverage of the article being coated and attractive appearance are usually the only essentials for any particular coating method to find application in the photographic art it must provide for precise control. In particular, a photographic element requires individual layers which are extremely thin, i.e. a wet thickness which is maximum about 0.015 centimeters, and generally is far below this value and may be as low as about 0.001 centimeters. After coating the layers have to be set and/or dried before the product can be handled and their surfaces generally cannot be subjected to any physical treatment to increase their smoothness and/or their thickness uniformity. For this reason, the coating composition must be applied to the support in such a precise manner that after the layer is set and/or dried it will already be within permissible tolerances with respect to both thickness and uniformity. Since an individual layer must be extremely thin, as is indicated above, and since the maximum variation in thickness uniformity is mostly plus or minus a few percent, it will be appreciated that the coating operation in the manufacture of photographic elements is an unusually complex and demanding procedure. Moreover, the difficulties involved in meeting the requirements of extreme thinness and extreme uniformity are further magnified by the fact that in order to be commercially practical the coating operation must be capable of handling continuous webs with a width up to one meter or more and must permit the web to be coated at high speeds, for example, speeds as high as several hundred centimeters per second.

A particularly useful coater for realizing the aims set forth hereinbefore is a curtain coater. If such apparatus is arranged to provide exact control of the means by which the free-falling curtain is generated, and if certain critical relationships between the operating variables are maintained high quality photographic elements may be produced with this type of coater. Basic patents on the use of a curtain coater for the production of photographic elements are U.S. Pat. No. 3,632,374 relating to a single layer, and U.S. Pat. No. 3,508,947 relating to a multiple-layer curtain coater.

A phenomenon that may be noticed at coating speeds higher than approximately 150 $m.min^{-1}$ is the displacement of the curtain in the direction of the web movement by the air entrained by the web. This displacement is moreover, not uniform since the curtain assumes a wavelike or undulating deformation, considered in the transverse direction of the curtain. The curtain deflections are largest at the web surface, and decrease to zero at the lip edge of the hopper. As a consequence of the curtain deformation, the coated layer gets longitudinal bandlike thickness deviations. These bandlike deformations are of the order of magnitude of only a few percent, and are not serious in the case of opaque photographic materials that are viewed or used in reflection. In the case, however, of photographic materials that are viewed in transmission, the density variations caused by bandlike thickness variations of one or more light-absorbing layers of the photographic material, whether these layers are light-sensitive or not, are unacceptable.

b. Description of the Related Art

It has been proposed to obviate the mentioned problem by means of different techniques.

First, it is known to provide the coater with shield means that extends parallel with the curtain and terminates closely to the web surface, with an end portion deflected in countercurrent direction. The shield means may occasionally be provided with a vacuum manifold operatively connected thereto for evacuating air from the surface of the web. Such an improvement is disclosed in U.S. Pat. No. 3,867,901. We have noticed that at speeds over 150 to 200 $m.min^{-1}$, depending on the thickness of the applied layer, the mentioned shield means do not prevent the formation of bands in the coated layer. Further, the arrangement of the shield is critical since any contact of the lower edge of a shield with the web causes scratching of the web and the production of dust, and yet the distance should be almost zero in order to produce a satisfactory effect.

Another arrangement for the removal of the boundary layer of air from a web in a curtain coater is disclosed in FR-A No. 1,463,674. In this patent specification a coater is described in which a web is transported through a coating curtain by means of a conveyor roller before and after the curtain, and in which the web is slightly downwardly deflected by contact with a knife edge that forms an air-tight joint between the knife and the web, and is located a certain distance upstream of the curtain. According to an alternative embodiment of the arrangement, the knife is hollow and has an open edge at its underside, whereby the entrained air may be sucked off. The knife effectively removes the boundary layer of air from the web and also stabilizes the curtain, as well as the web, but its use is excluded in the manufacturing of photographic elements since the frictional contact with the support inevitably damages the surface of the support. Damaging of a delicate web will also occur by particles of dust and the like that become collected at the front side of the knife and that cause scratching of the web surface.

A still further arrangement for the removal of the layer of air that is entrained by the web, comprises a concave plate that is curved concentrically about the axis of the web-supporting roller and spaced therefrom over a distance not larger than about 1 mm. The narrow gap that is formed between the air shield and the web on the roller forms an important resistance to the air entrained with the web, and permits thereby the use of higher coating speeds. The mentioned arrangement is disclosed in Research Disclosure No. 18916 of January, 1980, but also with this arrangement a practical upper limit of the coating speed is formed by approximately 200 $m.min^{-1}$ for a shield spacing of 1 mm. Smaller shield spacings can be used due to construction problems only for smaller curtain widths, such as curtain widths smaller than about 40 cm.

Finally, there is disclosed in DE-B-1,269,546 a curtain coater in which objects to be coated are transported by means of two endless belts through a coating zone. Disturbing influences of air displacements in the coating room and of air entrained by the objects are reduced by the provision of brushes that bear on the end of the straight advancing stretch of the first belt. The effect of the described measure is limited and is in fact advantageous only for the types of coating that are disclosed in this document, namely paints and adhesives.

Object of the Invention

It is the aim of the present invention to provide an improved curtain coater that enables the application of thin layers at elevated speeds by means of curtain coating in the manufacturing of photographic elements, that is simple of construction and easily to adjust and to maintain.

Summary of the Invention

According to the present invention, a curtain coater for coating a layer of liquid photographic coating composition on a continuous web in the manufacture of a photographic element, which comprises a coating hopper for producing a free-falling curtain of coating composition, a backing roller for moving said web along an arcuately curved path underneath said hopper to receive said curtain from said hopper, and an air shield that is concavely curved about an angular portion of the backing roller and that defines with said roller a gap that forms an important resistance for air entrained with the web, is characterized thereby that between the downstream end of the air shield and the curtain there is provided an elongate brush arrangement, the extremities of the bristles of which are in resilient contact with the web supported on the backing roller, and the contact of the bristles with the web occurring at a distance g not larger than 25 mm upstream of the line of contact of the curtain with the web.

The operation of the brush arrangement to remove the boundary layer of air from the support to an extent that is satisfactory to allow higher coating speeds than before, is surprising. As a matter of fact, the inventive brush arrangement does not constitute a knife-like cutting edge, nor does it operate to form an airtight joint with the web.

Yet it forms a very effective instrument for the efficient interception of the layer of air entrained with the web. The effect of the invention measure is based on the combination of a pre-removal of the entrained air, namely by the concavely curved air shield, with a more thorough removal by brushes that are spaced not more than 25 mm from the curtain.

The fact that the brush bristles do not cause damage to the delicate photographic material is surprising. As a matter of fact, either the photographic support is still uncoated, and in such case the exposed surface such as a PE (polyethylene) layer of a PE coated paper web presents a vulnerable surface, or the support has received already one or several layers and thus these gelatin-based layers are still more vulnerable to scratching.

The brushes may take many forms and compositions. It is clear that brushes with bristles or hairs that are stiff and/or sharp-ended are not suited for use in the present application. The bristles are suitably made from natural, plastic, or carbon fibers or threads with a length between approximately 5 and 50 mm and a thickness smaller than about 0.2 mm. The thickness of the fiber bundles may range between a few tenths of a millimeter to some millimeters. The length of the brush arrangements may be sufficient to cover the desired coating width with one structure, but in the case of shorter structures, they may be joined with their extremities in abutting relationship to obtain the desired overall length, or they may also be mounted staggered, with their ends in overlapping relation thereby to avoid gaps at the cross-over between two adjacent structures.

The bristles of the brush arrangements must be so flexible that they are capable of being deflected by a moving web, even if the pressure of the bristles on the web is very small. It is especially important that the contact pressure between the bristles and the web be uniform over the width of the web, and for that end the operator may have to adjust one or both ends of a beam that supports the brush structure radially as well as tangentially to the web-supporting roller.

In that connection, it will be understood that it is important that the bristle ends be located nearly in one plane, and therefore it may be necessary after the assembling of the brush arrangement, to cut or otherwise trim the bristle ends to obtain the desired alignment of their extremities.

The brush arrangement according to the invention does not form an airtight shield, because it is simply not capable of doing so as a consequence of its construction. To illustrate the matter, brush arrangements that have been successfully used in the application of the invention were so open that, if the operator held such a structure in front of the eye and looked to the sky, he could easily look through the bristles and notice said sky.

In the operation of the coater according to the invention, it was surprising that although the brush arrangement operated to collect and catch to some extent particles of dust and the like that inevitably are carried along with a web, the caught particles did not cause damage to the web. If damage would have occurred indeed, the system would be impractical, unless costly additional measures would be taken in order to attain an extremely clean web. It is believed that the explanation for the satisfactory operation of the brush arrangement in this respect resides in the flexibility of the bristles, and the very small contact pressure of the bristles on the web.

It will be understood that soiling of the bristles must not go on indefinitely, since the risk exists for larger agglomerates of trapped particles to finally loose adherance with the bristles and to slip under the brush. Suchlike agglomerates become then wound between two successive convolutions of the roll of web, and causes a permanent defect in the web surface.

The term "web" as used in the statement of invention includes uncoated supports made of paper, film base, and the like, but also supports that have received already one or more coatings, such as a subbing layer, a first light-sensitive layer, etc.

The term "layer" stands for a single as well as for a multiple layer of coating composition. A multiple layer may comprise two, three or more distinct layers that have been formed through separate slots, but that are brought into contact with each other before they leave the coating hopper.

According to a suitable embodiment of the invention, the brush arrangement is placed at a distance between 5 and 20 mm upstream of the line or locus of coating, i.e. the line where the coating first contacts the moving web. Smaller distances of the interception means involve the risk for a swinging curtain to touch and to soil the interception means, whereas larger distances strongly reduce the effect of the air removal.

According to a further suitable embodiment of the invention, the brush arrangement may be provided with a flexible strip at its upstream side, the free edge of said strip being spaced from the web by a distance of some millimeters, preferably at least two millimeters. The mentioned strip increases the efficiency of the brush arrangement as will be explained in the description hereinafter.

BRIEF DESCRIPTION OF THE DRAWINGS

The invention will be described hereinafter by way of example with reference to the accompanying drawings, wherein.

DESCRIPTION OF THE PREFERRED EMBODIMENTS

Figure 1:
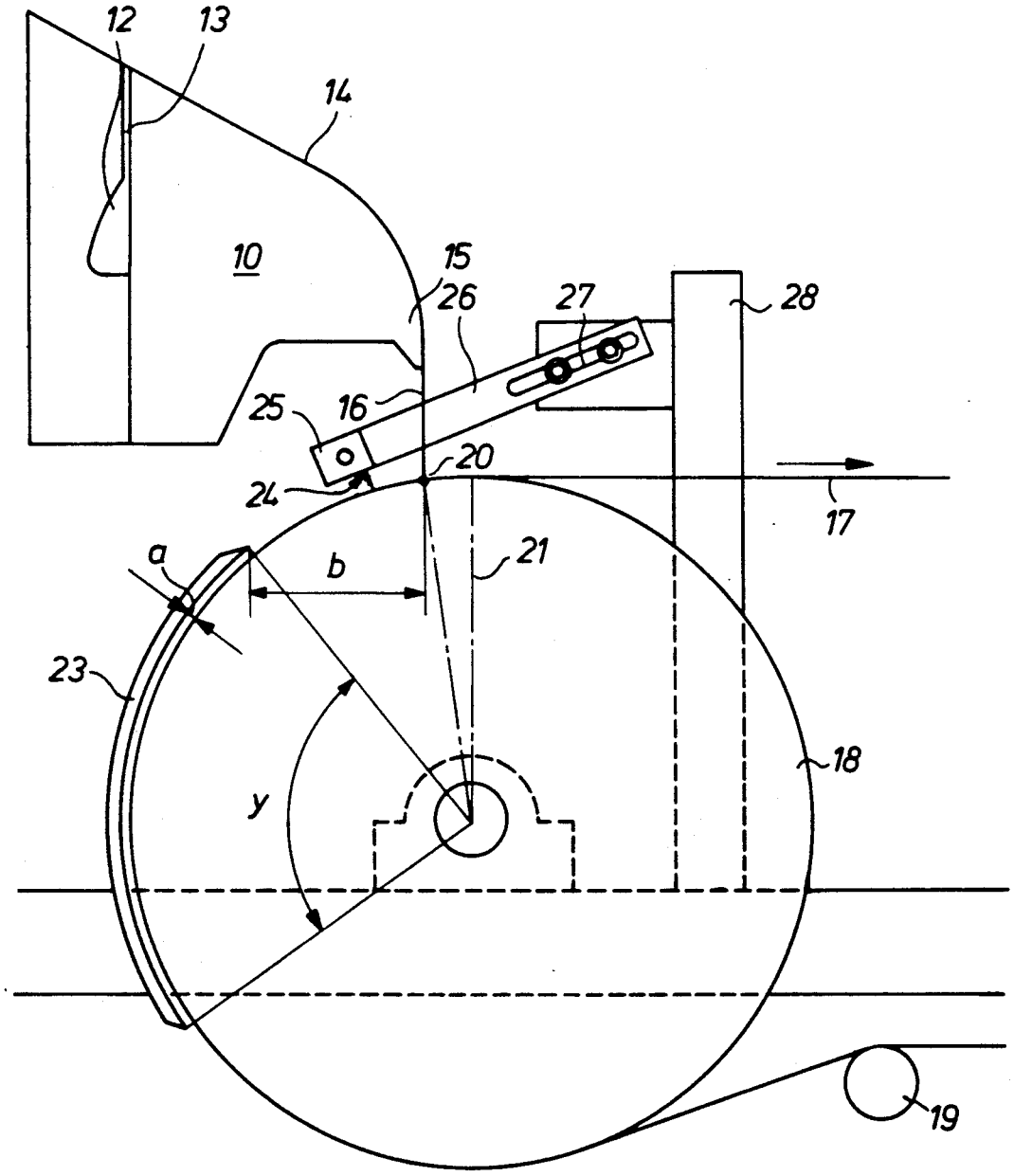
FIG. 1 is a diagrammatic illustration of one embodiment of a curtain coater.

Referring to FIG. 1, a curtain coater is illustrated comprising a coating head 10 of the slide-hopper type that is arranged for applying a layer of liquid coating composition on a moving support by curtain coating. The hopper is supplied with coating composition through a manifold 12 and has an elongate discharge slot 13 from which the coating composition flows over a slide surface 14 unto a lip 15 from which it falls freely downwardly in the form of a curtain 16. The hopper extends transversely of the path of travel of a web 17 to be coated, the path of which is determined by a web-supporting roller 18 to which the web is advanced over a guide roller 19.

Means is provided, not illustrated, for controlling the correct web speed, the lateral web position, and the web tension.

Edge guides (not shown) as known in the art are provided near both lateral ends of the lip 15 that are in adherent contact with the edges of the free-falling curtain and that thereby keep the curtain stretched in the transverse direction until it contacts the web on a transverse line, constituting the coating locus, illustrated in the figure by the point 20.

The coating hopper preferably is mounted for vertical displacement so that the height of the curtain may be adjusted and in consequence the speed of impingement of the curtain on the web be set. Further, the coating hopper 10, or the roller 18 may be arranged for horizontal displacement so that at the starting of a new coating procedure, the coating may be made to fall from the lip directly into a pan (not illustrated) until a liquid flow free of entrained air bubbles and a satisfactory transverse thickness profile of the curtain have been established. Then the hopper or the roller 18 may be reset to obtain the operative position as shown in the figure. Alternatively, displaceable shield means may be provided between the lip 15 and the roller 18 in order to temporarily intercept the curtain from contacting the web 17, until a stable curtain has been established.

The coater comprises an air shield 23 that is concavely curved concentrically about the axis of the roller 18 and that is spaced from the web on the roller over a distance a. The shield subtends an angle y and is spaced from the curtain at its trailing edge by a distance b.

The coater comprises further an elongate brush arrangement 24 that is fitted to a supporting beam 25 that extends transversely over the path of the web. The beam is supported between two parallel arms, only the arm 26 being shown, that each are adjustably fitted by means of a slot mechanism 27 to a vertical column, such as the column 28.

Figure 2B:
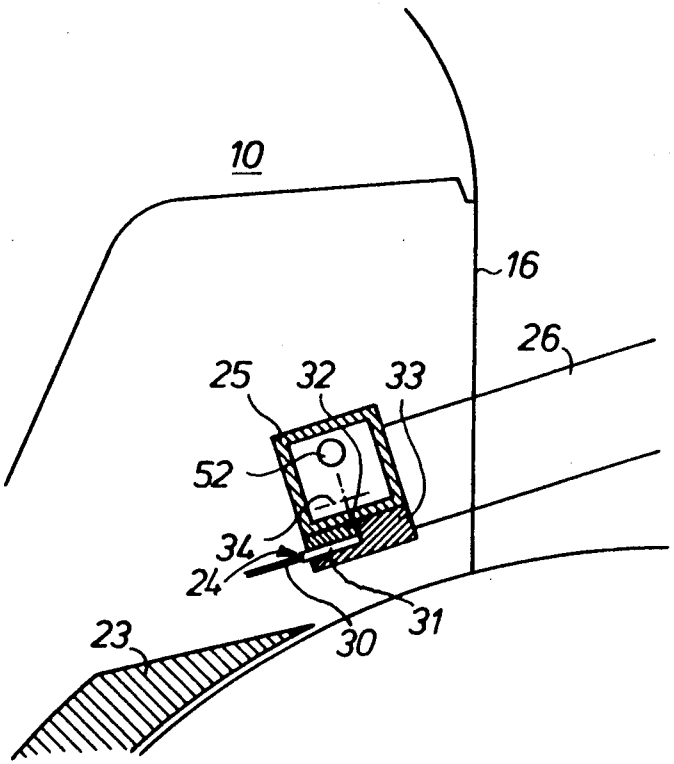
FIG. 2*b* is a detail view of the arrangement of a brush arrangement in the inoperative position.
Figure 2A:
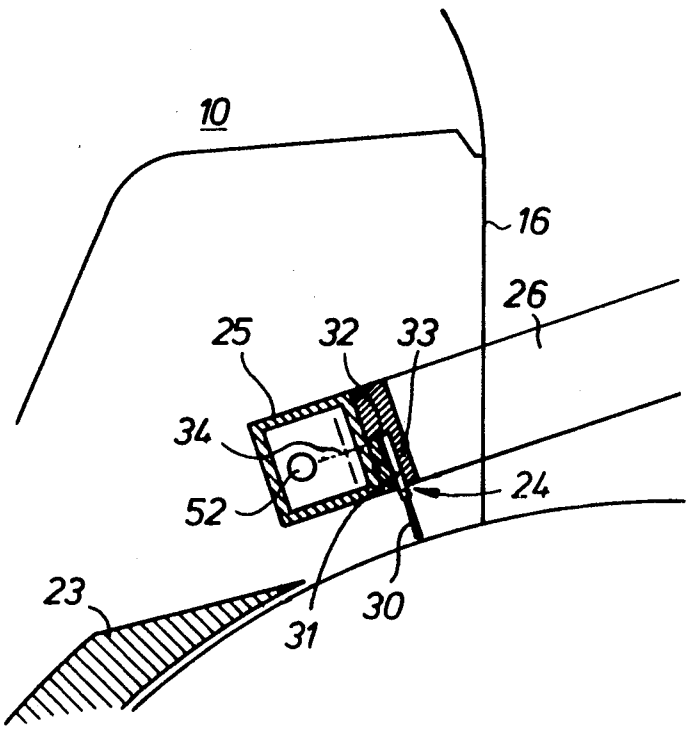
FIG. 2*a* is a detail view of the arrangement of a brush arrangement in its operative position.
Figure 3:
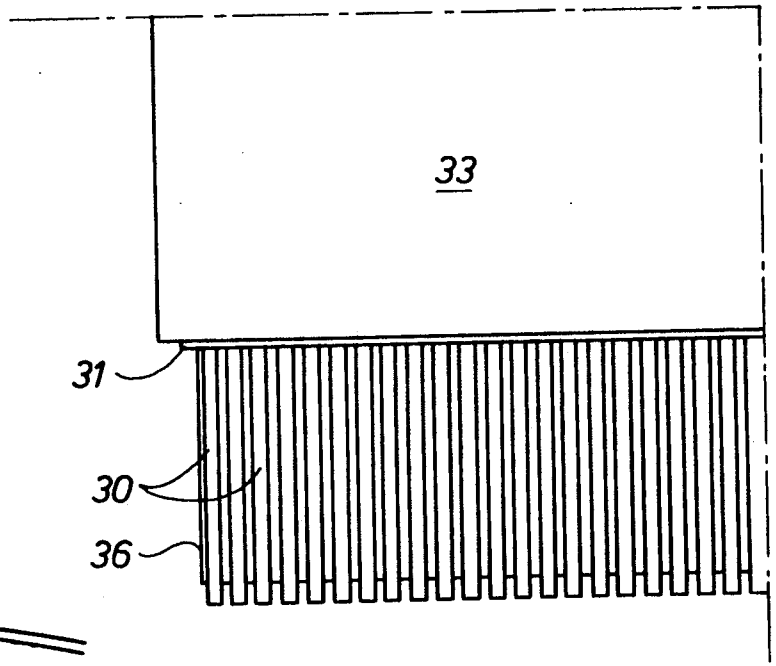
FIG. 3 is a plan view of the brush arrangement according to arrow 3 of FIG. 4.

FIGS. 2*a*, 2*b*, 3 and 4 illustrate the brush structure in detail. The brush structure comprises bundles 30 of individual bristles that are fixed into a base or body 31. The handle may be in the form of a plastic strip, a folded metal strip, or the like. The base 31 is attached to the beam 25 by means of the co-operating clamps 32 and 33. The beam 25 with the attached brush is pivotable about an axis 34 indicated in crossing lines, so that it may take an operative position as shown in FIG. 2*a*, and an inoperative position shown in FIG. 2*b*. The advantage of the pivotable mounting of the brush structure is that the structure may be easily cleaned, inspected and replaced. The rotatable beam may occasionally be arranged for carrying brush structures at different angular points, so that rotation of the beam may put one structure out of service and replace it instantly by another one.

The mounting of the base 31 in the present arrangement is such that in the operative position it is truly radial with respect to the roller.

Figure 4:
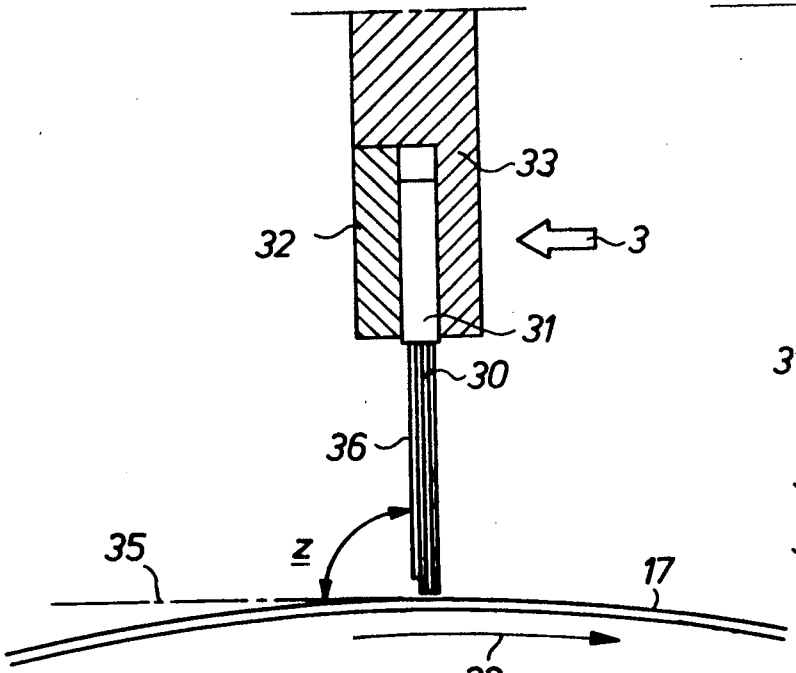
FIG. 4 is a side view of the structure of FIG. 3.

The bristles of the brush structure have been illustrated in FIG. 4 as just touching the web as supported on the roller. This situation is the rest position of the coater. If the web 17 is advanced in the direction of arrow 22, the bristles 30 are very slightly deflected towards the right side of FIG. 4 by the friction between their ends and the web surface so that no longer a right angle z is formed between the bristles and the tangent 35 to the web at the upstream side of the brush structure, but rather a sharp angle instead.

If rather high web speeds and rather flexible bristle structures are involved, it may be desirable to use an air impervious flexible shield in the form of a strip or flap of plastic, sheet metal or the like, that may be mounted together with the bristles in the handle 31, and that extends closely along the bristles up to approximately 2 to 5 mm from the free extremities. Such a flap is illustrated by the numeral 36 in FIGS. 3 and 4. The flap may be positioned at the downstream side of the bristles, considered according to the direction of movement of the web, but the flap may also be provided just upstream of the bristles, as illustrated in FIG. 4 wherein the angle z between the flap 36 and the tangent 35 to the web in the point of contact of the bristles with the web is practically 90 degrees and wherein the angle between the bristles and the web is likewise practically 90 degrees.

Measurements of the rate of air downstream of the brush structure have shown that the flap operates more effectively if placed at the upstream side of the brush structure.

It is believed that the effect of the flap resides mostly in the covering of the open spaces between the fibre bundles of the brush structure near the root of the bundles. These open spaces gradually decrease toward zero in the direction of the free ends of the bristles.

The operation of the apparatus according to the invention is described hereinafter in more detail with reference to the remaining drawings figures, for different values of the web speed, the shield distance, etc.

The air velocities at different points above the peripheral surface of a driven roller have been measured by means of a laser doppler anemometer. The term "measuring point" as will be used hereinafter, is the point of intersection of the two laser beams of the laser anemometer.

Figure 5:
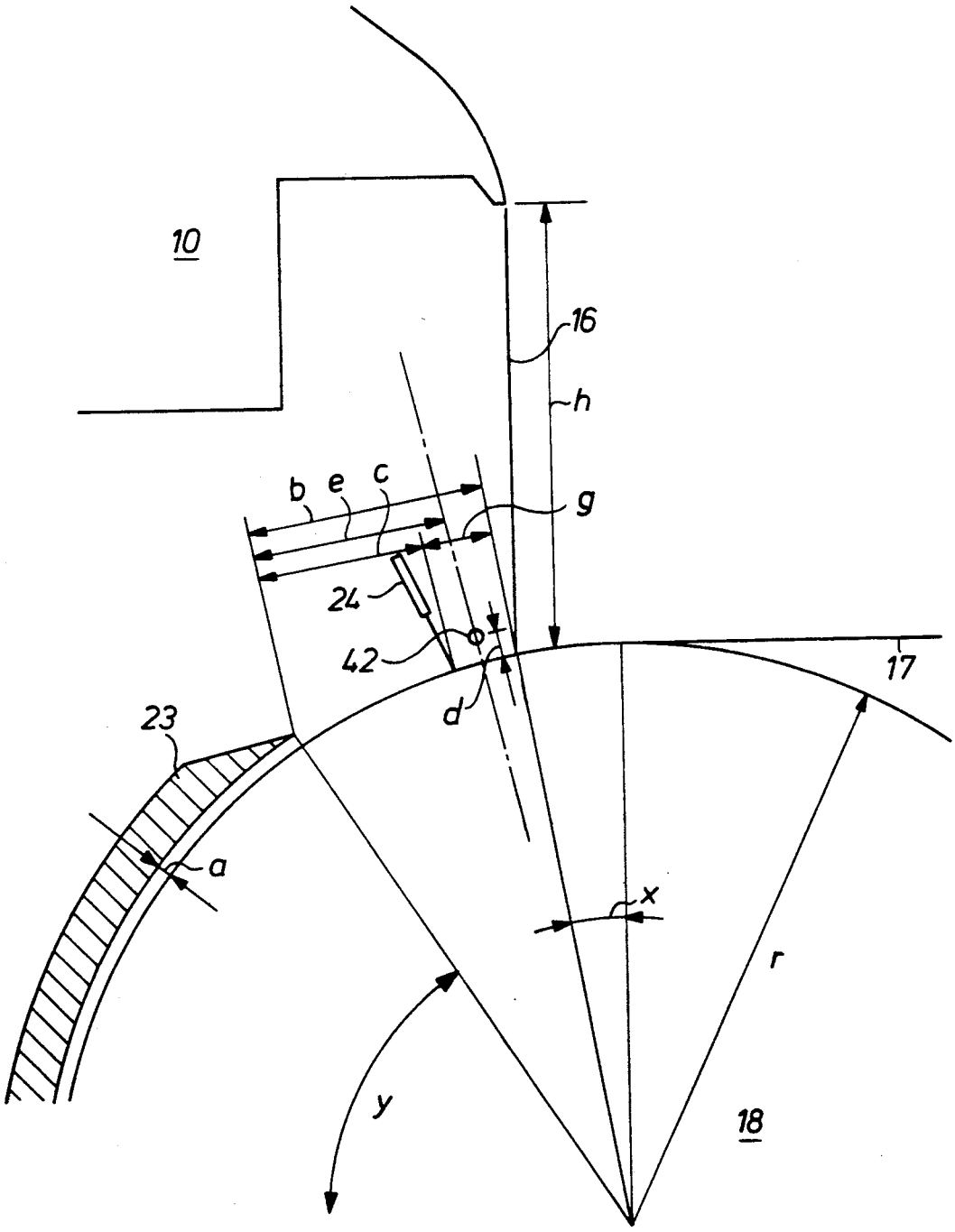
FIG. 5 illustrates different variables of the apparatus.
Figure 6:
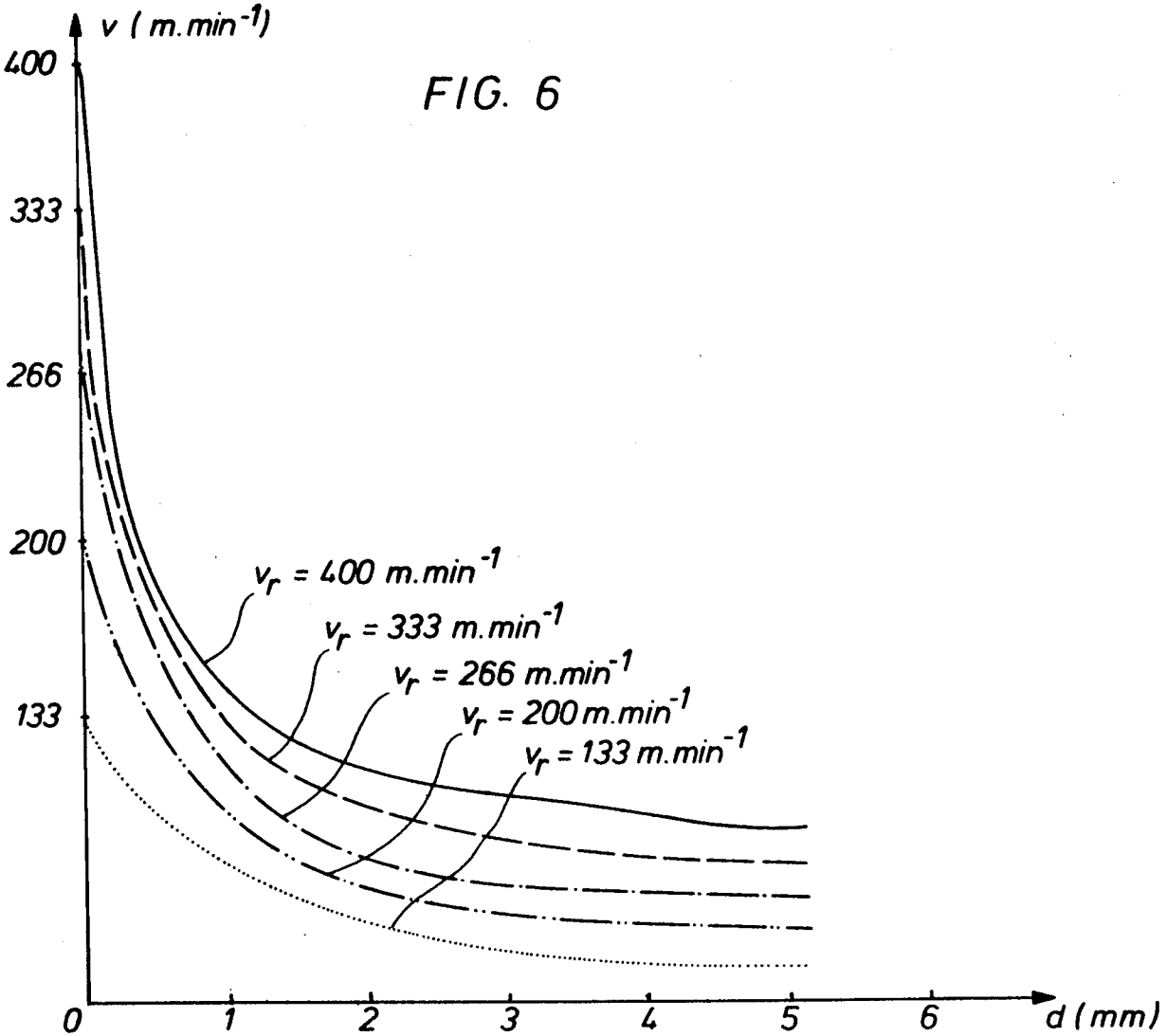
FIG. 6 is a diagram of air velocities at different distances from a moving web.

Curves representing air velocities as a function of the distance d of a measuring point 42 from the roller surface (see FIG. 5) for different velocities $v_r$ of said surface, is illustrated in the diagram of FIG. 6 wherein the abcissa represents d in mm, and the ordinate represents v, i.e. the measured air velocity, in $m.min^{-1}$. The measurements were carried out with the air shield 23 and the coater 10 removed from the roller 18.

It may be seen that for a distance $d=0$, i.e. the measuring point 42 being situated right on the surface of the roller 18, the measured velocities v perfectly correspond with the actual roller speed which may be calculated from the number of revolutions per minute of the roller and the roller diameter. In the present example the diameter of the roller 18 was 230 mm, and the length of the roller amounted to 240 mm.

The area of the diagram included between any curve and the abcissa is important, since it represents the rate of air flow that will impinge on the curtain of coating composition, since such curtain is in fact a shield that is in the way of the air entrained with the moving roller surface (i.e. in practice the web surface). It may be seen that the rate of air flow that is comprised between $d=0$ and $d=1$ mm increases beyond proportion at speed higher then 200 $m.min^{-1}$, as compared with d larger than 1 mm, and it is clear that this rapid increase of the amount of air entrained closely to the roller surface, gives rise to the undesirable disturbance of the vulnerable curtain at the position where the effect is greatest, namely at the position of impingement on the web.

The measured air velocities remain absolutely constant if the measuring point is displaced in a direction parallel with the roller axis, and thus it could be concluded that the impingement of a uniformly structured air volume on a coating curtain that itself is likewise extremely uniform, only could result in the uniform deflection of the curtain in the direction of the web advance. However, practice shows that the curtain deflection is not uniform, and that instead the curtain is deformed in an undulating way as described already in the introduction of the specification, the nodes and the anti-nodes of the undulations taking a steady position according to the transverse direction of the curtain. These wavelike deformations of the curtain cause corresponding thickness variations of a coated layer as has been confirmed experimentally.

Figure 7:
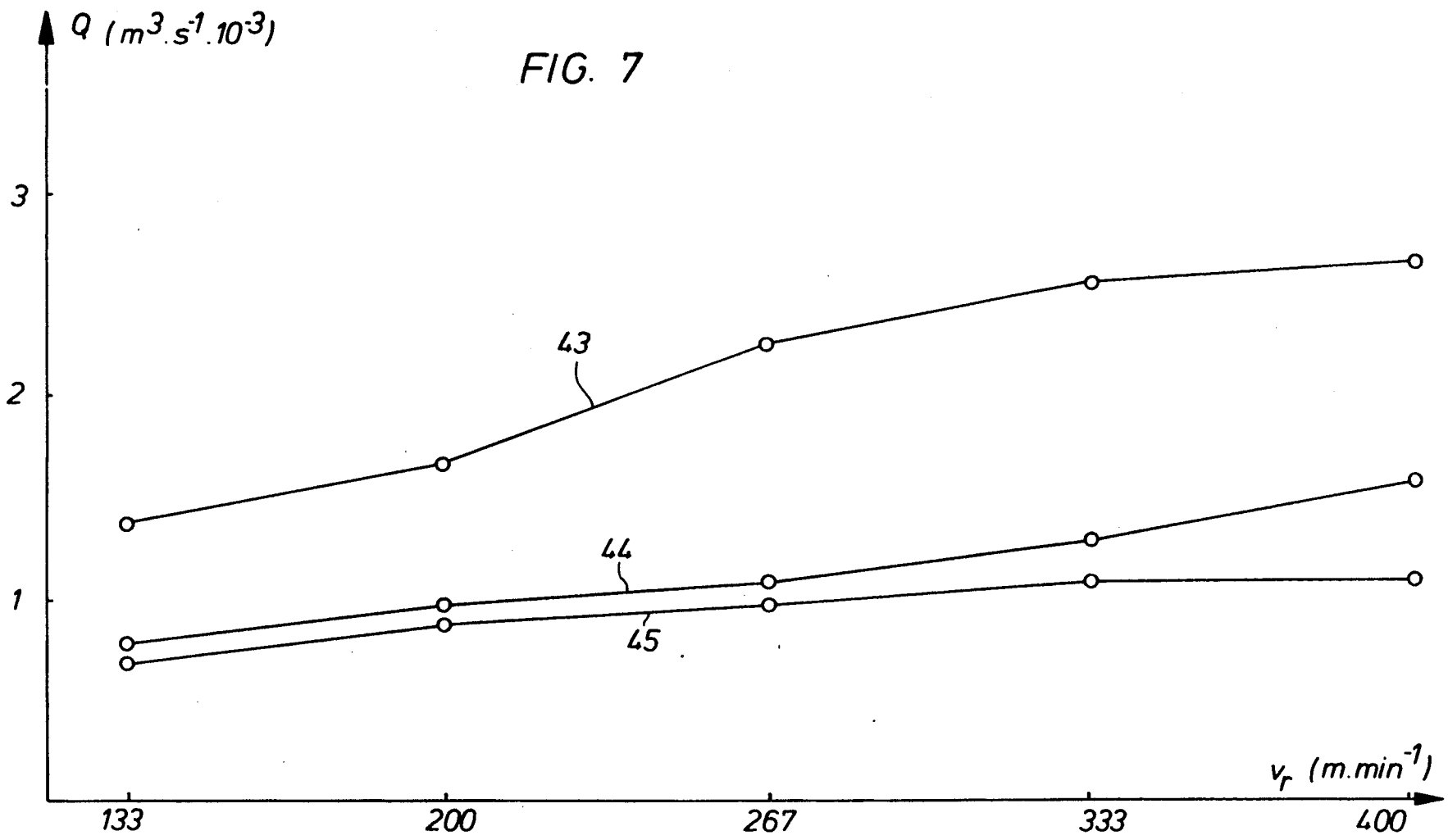
FIG. 7 is a diagram of the air rates at different coating speeds, for two types of brush structures.

A diagram that illustrates the rates of air flow that were measured at a distance of 10 mm downstream of means that was provided for the removal of the air entrained by the roller, is shown in FIG. 7 wherein the ordinate of the diagram represents the air flow Q expressed in $m^3.s^{-1}.10^{-3}$ of air per meter width, and the abcissa of the diagram illustrates the peripheral speeds $v_r$ of the roller.

The curve 43 represents the result where only the air shield 23 was in use as a means for removing the entrained air.

The curve 44 represents the result of the combination of the air shield 23 with a brush arrangement 24 with 13 bundles of bristles per cm length, whereas curve 45 stands for a combination of the air shield with a brush arrangement with 26 bundles of bristles per cm length. Each bundle comprised approximately 35 fibers per bundle. The thickness of the fibers was 0.06 mm.

Further details of the arrangement are as follows:

Distance a: 0.3 mm
Distance c: 30 mm
Distance e: 10 mm (in the case of no brush arrangement)
e: 40 mm (in the case of a brush arrangement)
Angle y: 90 degrees (angular extent of the shield)

The diagram illustrates that the air shield has only but a limited effect (curve 43) on the removal of air entrained with the web.

In this connection, it should be considered that the air shield was located at a distance of 0.3 mm from the web, which distance can only be used for limited web widths. A distance of 1.0 mm would provide even worse results.

Curve 44 shows that the addition of a brush structure to the air shield considerably improves the removal of entrained air, and curve 45 shows that the use of a brush structure with a double bristle density slightly further improves the air removal, especially at more elevated speed, such as 400 $m.min^{-1}$.

EXAMPLE I

Figure 8B:
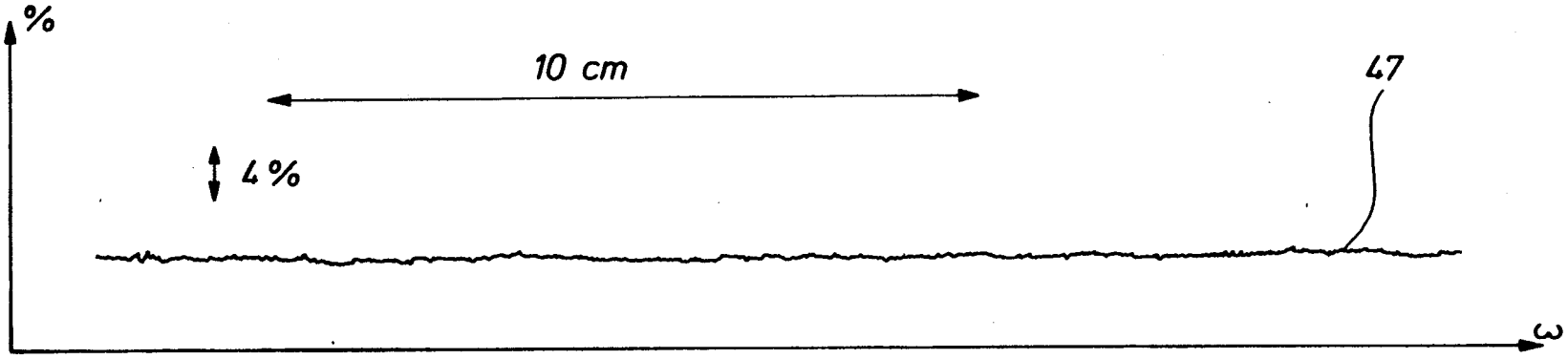
FIG. 8*b* is a diagram illustrating the thickness variations of a layer coated by the inventive coating apparatus.
Figure 8A:
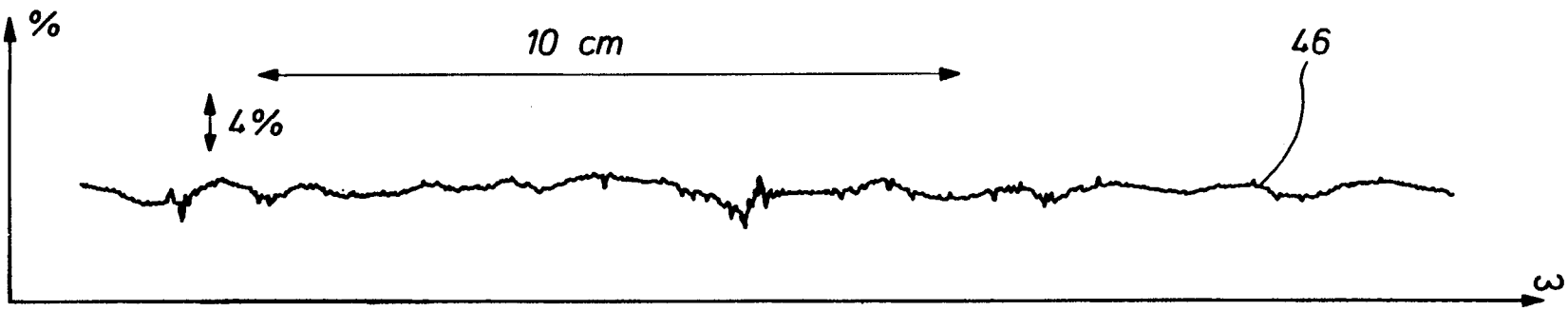
FIG. 8*a* is a diagram illustrating the thickness variations of a layer coated by a conventional curtain coater.

The results of a practical coating that was performed by means of a curtain coater according to the invention, are illustrated in the diagrams of FIGS. 8*a* and 8*b*, wherein the abcissa w represents an arbitrary portion of the width of the web, and the ordinate represents the thickness variations of the coated layer in percent. The different variables of the coater were as follows with reference to FIG. 5:

a: 1 mm
b: 30 mm
c: 20 mm
g: 10 mm
h: 80 mm
r: 150 mm angle x: 20° (with respect to the vertical)
angle y: 120°
$v_{web}$: 200 m.min$^{-1}$ The web was a polyethylene terephthalate support with a thickness of 0.1 mm. The support was provided with a subbing layer onto which a backing layer containing light-absorbing pigment was coated at a wet thickness of 40 um (micrometer). The dry thickness of said layer was 5 um. The thickness of the layer was determined by an optical density measurement. The curve 46 of FIG. 8*a* represents the thickness variations of the coated layer, the brush arrangement 24 being pivoted away from the coater. It may be seen that the peak-to-peak thickness deviations of the coated layer attain approximately 5%.

During the coating, the brush arrangement was pivoted into operation and the thickness profile of the same section of the coated layer that was then obtained is illustrated by the curve 47 of FIG. 8*b*. The thickness variations have now become smaller than 1.5%. The brush arrangement was of the type provided with 13 bundles of bristles per cm length, and 35 fibers per bundle, as described hereinbefore with reference to FIG. 7.

EXAMPLE II

The results of another coating are illustrated in FIGS. 9*a* to 9*d*, wherein the abcissa of the diagrams likewise represent an arbitrary portion of the width of the web, and the ordinate represents the thickness variations of the dry coated layer in percent.

Figures 9A, 9B, 9C, 9D:
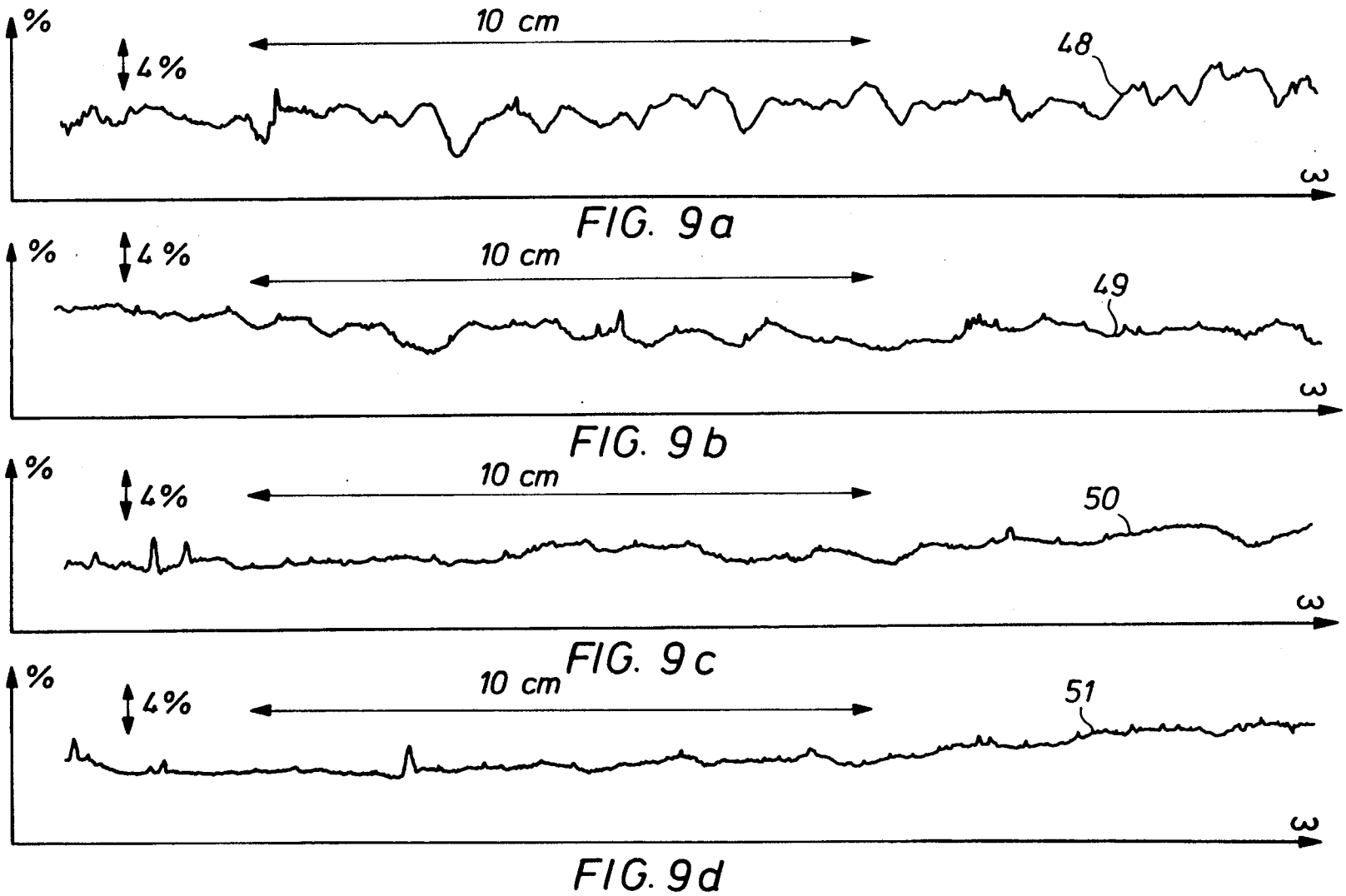
FIGS. 9*a* to 9*d* are diagrams illustrating the thickness variations of a layer coated at different settings of the brush arrangement.

The different variables of the coater according to FIG. 5 were as follows:

| | |
|---|---|
| a | 1 mm |
| b | 30 mm |
| c | 20 mm |
| g | no brush structure in FIG. 9a |
| | 25 mm, FIG. 9b |
| | 10 mm, FIG. 9c |
| | 5 mm, FIG. 9d |
| h | 80 mm |
| r | 150 mm |
| angle x | 20° |
| angle y | 120° |

The web was a subbed polyethylene terephthalate support with a thickness of 0.1 mm onto which a backing layer was coated at a wet thickness of 26 um. The dry thickness of the layer was 4 um.

The brush arrangement was of the type provided with 13 bundles per cm length, and 35 fibers per bundles, as mentioned hereinbefore.

Curve 48 of FIG. 9*a* illustrates that peak-to-peak variations of 6% occur in the coated layer.

Curve 49 of FIG. 9*b* illustrates that the provision of a brush arrangement in accordance with the invention with g=25 mm reduces the thickness variations of the layer to approximately 4%.

Curves 50 and 51 illustrate that a reduction of the distance between the brush arrangement and the curtain still further reduces the thickness variations, namely to 2% for a 10 mm, respectively 1.5% for a 5 mm distance.

It should be noted that the slightly generally sloping profile of the curves 9*a* to 9*d* is not due to effect of air removal, but may be caused by minor deviations in the coater adjustment, roller diameter, etc. These minor gradual thickness deviations are insignificant in practice.

The invention is not limited to the described embodiments.

The brush arrangement may take other forms than the illustrated one. The numbers of fibers may exceed the number of 455 fibers per cm length (13×35) as disclosed in the examples. The structure may comprise two or more rows of brushes mounted in parallel. In the case of more brushes mounted in parallel, only one or some of them may be provided with a flap.

The brush arrangement may be provided with heating means for heating the structure in view of occasional vapour condensation effects on the brush fibers or on the brush flap. A suitable heating system comprises electrical heating rods, cartridges or wires that are provided inside of the hollow supporting beam, as illustrated by the numeral 52 in FIGS. 2*a* and 2*b*.

The beam 25 which supports the brush arrangement may be a glass tube which is arranged for pivotation about its axis. The brush arrangement may be attached e.g. by gluing to the outer surface of such tube, and in a suitable arrangement such tube may be the shell of an elongated fluorescent tube that may be useful for the illumination of the coating region thereby to be able to examine the coating process in the case of non-lightsensitive coatings, such as used for subbing layers, antistress and antihalation layers, colour filtering layers, etc.

The brush arrangement may be arranged for being covered in the inoperative position thereby to prevent the bristles from occasionally being soiled, e.g. during the starting procedure of the coater. To that end, a hood or the like may be provided in the coater for covering the bristles while in their inoperative position.

The brush arrangement according to the invention may be used in conjunction with still other measures for the removal of the entrained air, such as a source of reduced air pressure that is connected to the concentric shield 23 in order to increase the efficiency of air interception thereof.

We claim:

1. In combination with a curtain coater for coating a layer of liquid coating composition on a continuous web in the manufacture of photographic material, which comprises a coating hopper for producing a free-falling curtain of coating composition extending across the web, a backing roller for supporting the moving web along an arcuately curved path underneath said hopper to receive at a coating locus on the web said curtain from said hopper, and an air shield plate that is concavely curved about a segment of said arcuately curved path with its downstream end in the direction of the coating locus in close spaced proximity to said locus and that defines with said roller a gap that forms a substantial resistance for air entrained with the moving web the improvement wherein downstream of the downstream end of the air shield and upstream of the curtain is located an elongated brush arrangement extending across the width of the web, said arrangement comprising flexible bristles having their ends in resilient contact with the web at a distance not larger than 25 mm upstream of the coating locus, said brush arrangement being mounted on a beam arranged for pivotation between an operative position with the bristles in contact with the web and inoperative position with the bristles removed from the web, said beam being provided with heating means.

2. Curtain coater according to claim 1, wherein said distance is between 5 and 25 mm.

3. Curtain coater according to claim 1, wherein the bristles have a length between 5 and 50 mm.

4. Curtain coater according to claim 1, wherein the brush arrangement includes a flexible air-impervious flap on the upstream side of the bristles, the free edge of said flap is separated from the web by a distance of a few millimeters.

5. Curtain coater according to claim 4 wherein the distance of separation of the flap edge is between 2 and 5 mm.

6. Curtain coater according to claim 1, wherein the density of the bristles of said brush arrangement is at least 455 bristles/cm of length.

7. Curtain coater according to claim 1, wherein said bristles are made from polypropylene.

* * * * *